US009435152B2

(12) United States Patent
Zimmer et al.

(10) Patent No.: US 9,435,152 B2
(45) Date of Patent: Sep. 6, 2016

(54) ACCELERATION AND DECELERATION ARRANGEMENT

(71) Applicants: Guenther Zimmer, Rheinau (DE); Martin Zimmer, Rheinau (DE)

(72) Inventors: Guenther Zimmer, Rheinau (DE); Martin Zimmer, Rheinau (DE)

( * ) Notice: Subject to any disclaimer, the term of this patent is extended or adjusted under 35 U.S.C. 154(b) by 0 days.

(21) Appl. No.: 13/962,894

(22) Filed: Aug. 8, 2013

(65) Prior Publication Data

US 2014/0026357 A1 Jan. 30, 2014

Related U.S. Application Data

(63) Continuation-in-part of application No. PCT/DE2012/000328, filed on Feb. 3, 2012.

(30) Foreign Application Priority Data

Feb. 9, 2011 (DE) ..... 10 2011 010 778

(51) Int. Cl.
*E05F 5/02* (2006.01)
*E05F 1/16* (2006.01)
*E05F 5/00* (2006.01)

(52) U.S. Cl.
CPC ..... *E05F 1/16* (2013.01); *E05F 5/003* (2013.01); *E05Y 2201/412* (2013.01); *E05Y 2800/205* (2013.01); *E05Y 2800/21* (2013.01); *E05Y 2800/24* (2013.01); *E05Y 2800/75* (2013.01); *E05Y 2900/00* (2013.01); *E05Y 2900/20* (2013.01); *Y10T 16/593* (2015.01)

(58) Field of Classification Search
CPC ..... E05F 1/16; E05F 5/003; A47B 88/047; E05Y 2201/412; E05Y 2800/24; E05Y 2900/20; Y10T 16/61
USPC ..... 16/82–86 C, 59, DIG. 10, DIG. 9; 312/333, 319.1, 139, 334
See application file for complete search history.

(56) References Cited

U.S. PATENT DOCUMENTS

| | | | | |
|---|---|---|---|---|
| 7,374,260 | B2 * | 5/2008 | Lu | 312/333 |
| 7,513,582 | B2 * | 4/2009 | Yoon et al. | 312/333 |
| 8,240,788 | B2 * | 8/2012 | Juan et al. | 312/333 |
| 8,307,497 | B2 * | 11/2012 | Chang et al. | 16/71 |
| 8,402,606 | B1 * | 3/2013 | Tsai | 16/49 |
| 2007/0114896 | A1 * | 5/2007 | Orita | 312/334.14 |
| 2009/0121596 | A1 * | 5/2009 | Ferrari | 312/334.8 |
| 2009/0273129 | A1 * | 11/2009 | Zimmer et al. | 267/170 |
| 2010/0026152 | A1 * | 2/2010 | Huang | 312/319.1 |
| 2011/0023370 | A1 * | 2/2011 | Zimmer et al. | 49/360 |

FOREIGN PATENT DOCUMENTS

| | | |
|---|---|---|
| DE | 10 2006 058 639 | 8/2008 |
| DE | 20 2010 007 230 | 9/2010 |
| DE | 10 2010 047 485 | 4/2012 |
| WO | WO 2006/097413 | 9/2006 |
| WO | WO 2007/111424 | 10/2007 |
| WO | WO 2010/043334 | 4/2010 |

* cited by examiner

*Primary Examiner* — Victor Batson
*Assistant Examiner* — Matthew Sullivan
(74) *Attorney, Agent, or Firm* — Klaus J. Bach

(57) ABSTRACT

In a combined acceleration and deceleration arrangement with a support and guide structure supporting a carrier element movable between a park position and an end position and an energy store which is charged when the carrier element is in the park position and discharged when it is in the end position, the carrier element has a guide part and a securing part and each has an engagement stop, the energy store being connected to the securing part and an operating element being connected to the guide part.

6 Claims, 7 Drawing Sheets

ACCELERATION AND DECELERATION ARRANGEMENT

This is a Continuation-In-Part application of pending international patent application PCT/DE2012/000328 filed 2012 Feb. 3 and claiming the priority of German patent application 10 2011 010 778.9 filed 2011 Feb. 9.

BACKGROUND OF THE INVENTION

The present invention concerns a combined acceleration and deceleration arrangement with a carrier element which is guided in a support and guide arrangement between a force- and/or form-locking secured park position and an end position. The arrangement includes at least two carrier abutments and an energy storage device which is arranged at the carrier element and is repeatedly chargeable and dischargeable. It is charged when the carrier element is in the park position and is discharged when the carrier element is in the end position. The deceleration arrangement includes also an operating element connected to the carrier element and a system with a pull- and braking arrangement pair.

DE 10 2006 058 639 A1 discloses such an arrangement wherein a carrier element is coupled to the carrier however in such a way that, after the coupling there is some play with respect to the carrier.

It is the principal object of the present invention to reduce the play of an acceleration and deceleration arrangement during use.

SUMMARY OF THE INVENTION

In a combined acceleration and deceleration arrangement with a support and guide structure supporting a carrier element movable between a park position and an end position and an energy store which is charged when the carrier element is in the park position and discharged when it is in the end position, the carrier element has a guide part and a securing part and each has an engagement stop, the energy store being connected to the securing part and an operating element being connected to the guide part.

The invention will become more readily apparent from the following description of exemplary embodiments thereof with reference to the accompanying schematic drawings.

DESCRIPTION OF EXEMPLARY EMBODIMENTS

Figure 1:
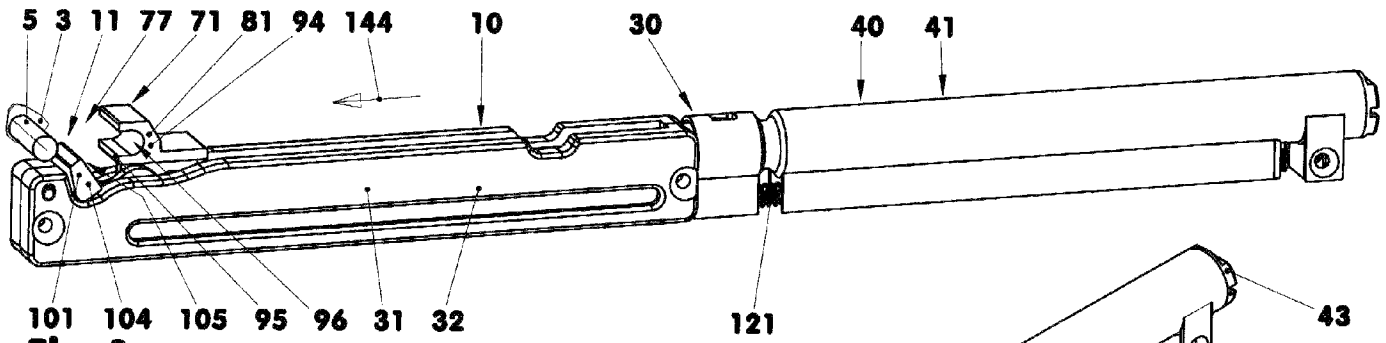
FIG. 1 shows the acceleration and deceleration arrangement in the park position.
Figure 2:
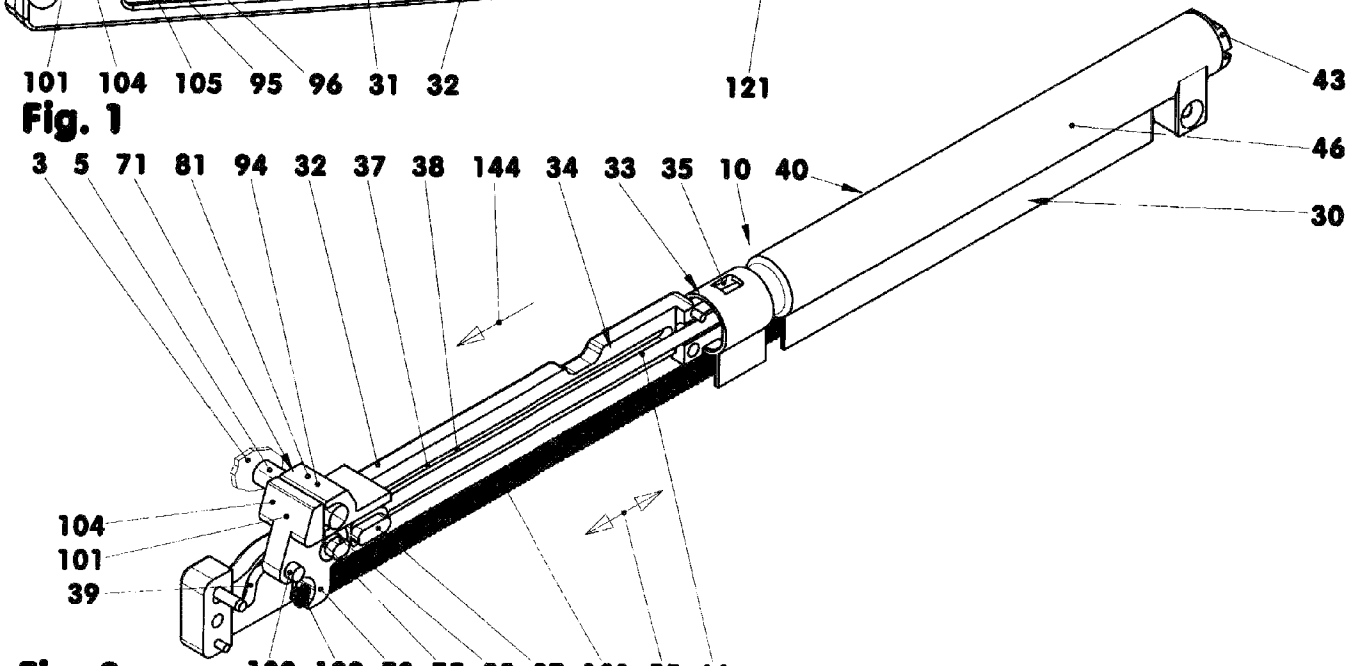
FIG. 2 shows the acceleration and deceleration arrangement in the park position with a housing part removed.

FIG. 1 shows a combined acceleration and deceleration arrangement 10 in a park position 11. Such an arrangement 10 is used for example in connection with a door such as a sliding door or a drawer, which is movable along a full travel path between an open and a closed end position, in both directions either by hand or by an operating motor. In a partial travel path next to one of the two end positions, the combined acceleration and deceleration arrangement 10 is engaged by a carrier 5 which is arranged for example at a furniture component 3. This engagement carrier causes the release of a carrier element 71 of the acceleration and deceleration arrangement 10, which couples to the carrier 5 out of the park position 11. The acceleration and deceleration arrangement 10, which is shown in FIG. 2 with a housing part omitted, takes over the control of the door or drawer movement. The door or the drawer is then accelerated linearly by an energy storage device 121, which is being discharged in the process but which can be recharged. Superimposed over the acceleration force is a deceleration force effective in the opposite direction. The carrier element 71 of the acceleration and deceleration arrangement 10 is moved to an end position 12 remote from the park position 11—see FIG. 3. The resulting force effective on the door or the drawer moves the door or the drawer to its end position where it comes to a standstill smoothly without a jerking or sudden stop.

During manual or motor-operated movement of the door or the drawer out of the end position thereof, the carrier element 71 of the acceleration and deceleration arrangement 10 is moved out of the end position 12 toward the park position 11. In the process, the energy storage device 121 is again charged. Upon further movement of the door or the drawer, in the park position 11 of the carrier element 71 the engagement between the carrier 5 and the acceleration and deceleration arrangement 10 is ended. The acceleration and deceleration arrangement 10 remains in the park position 11 until, with a renewed movement of the door or the drawer toward the end position, the carrier 5 is coupled to the carrier element 71.

The acceleration and deceleration arrangement 10 may also be arranged on a furniture part 3 while the carrier 5 is arranged on a door or a drawer.

The combined acceleration and deceleration arrangement 10 comprises a support and guide arrangement 30 with a cylinder-piston unit 41, the carrier element 71 and the energy storage device 121.

Figure 4:
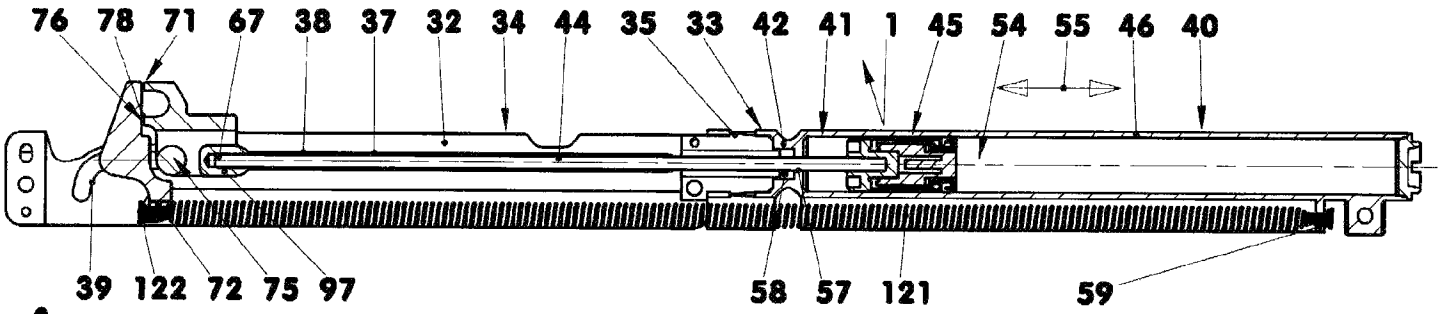
FIG. 4 shows the acceleration and deceleration arrangement in a longitudinal cross-sectional view.
Figure 5:
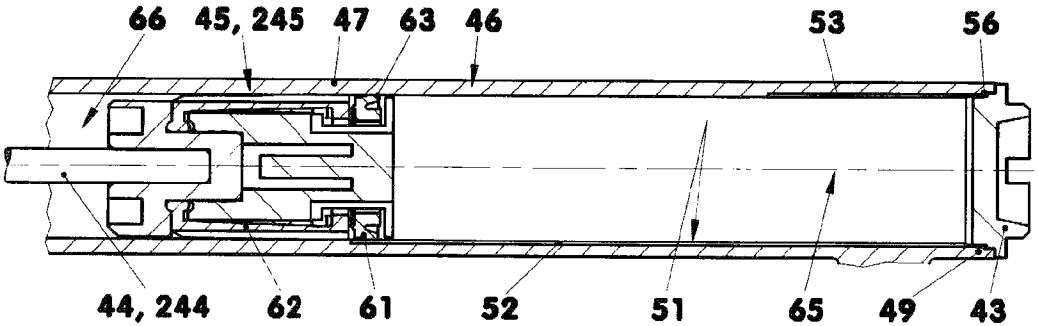
FIG. 5 shows a detail of the deceleration arrangement.

FIG. 4 shows such an acceleration and deceleration arrangement 10 in a longitudinal cross-sectional view. In FIG. 5, a part of the deceleration arrangement is shown in an enlarged view.

Figure 12:
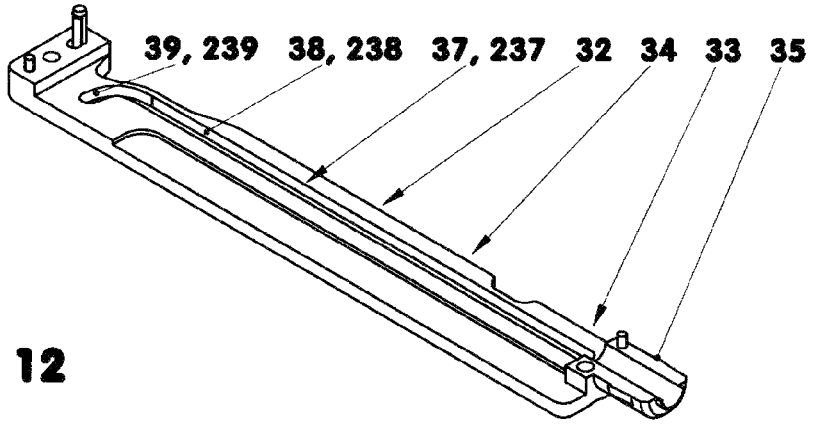
FIG. 12 shows a housing part.

The support and guide arrangement 30 comprises a two-part housing 31 with mirror-reversed housing parts 32. The housing 31 comprises a receiving area 33 and a guide area 34. In the receiving area 33, the cylinder piston unit 41 is supported by means of projections 35 engaging the cylinder head part 42. The guide area 34 comprises for example two guide tracks 37 arranged opposite each other. In the exemplary embodiment, these guide tracks 37 are grooves formed into the guide area and extending parallel to the stroke direction 55 of the piston 45 and the piston rod 44 of the cylinder-piston unit 41 over a guide section 38, with an adjacent section 39 being bent by a quarter of a circle. FIG. 12 shows a housing part 32 with a guide track 37. The section 39 which is not parallel to the direction of movement 55 may be straight or curved. In the representation of FIG. 4, the curved section 39 extends downward. The width of the groove is in the exemplary embodiment three millimeters. However, the housing may have a different shape. For example, at least one guide track section (38, 39) may be in the form of a guide structure such as a body edge.

The cylinder-piston unit 41 comprises a cylinder 46 in which a piston 45 is guided.

The cylinder 46 comprises a cylinder sleeve 47 with a head part 42 and a cylinder bottom 43 mounted in the cylinder sleeve 47. The cylinder sleeve 47 and the cylinder bottom 43 are manufactured for example by injection molding from a thermoplastic material for example polyoximethylene. The cylinder sleeve is—as shown herein—at the outside cylindrical and has in the cylinder head area an annular recess 48. Its length is for example nine times its outer diameter. The internal sleeve wall 51 is non-cylindrical and is for example in the shape of a truncated cone sleeve which facilitates its removal, from a die. The smaller cross-section of this truncated cone sleeve is in the head part 42 of the sleeve 46, the larger cross-section is at the cylinder bottom 43. The inclination of this cone is for example 1:140. The inner surface may be polished.

The inner cylinder wall 51 is provided for example with a longitudinal groove 52, which extends for example over 70% of the length of the cylinder, see FIG. 5. It ends at the cylinder bottom 43. Its width is for example 2% of the large diameter of the inner cylinder wall 51. Instead of a single groove 52, several grooves 52 may be formed into the inner cylinder wall 51. They may also extend screw-like along the inner cylinder wall 51 of the sleeve 47.

At the bottom end 41 of the cylinder sleeve 47, another longitudinal groove 53 may be formed into the inner cylinder wall 41. Its length is for example 15% of the length of the cylinder.

Each of these grooves increases the cross-section of the cylinder interior 54.

For the installation of the cylinder bottom 43, the bottom end 49 is provided for example with a twin-stepped rotational symmetrical annular recess 56. During installation of the cylinder bottom 43, the air from the area of the outer recess is displaced outwardly whereas the air from the inner recess is displaced into the cylinder interior 54. Also other embodiments of a hermetic sealing arrangement may be provided.

In the head part of this particular embodiment, the piston rod penetration 57 and a piston rod seal 58 which may be formed for example integrally with the head part 42 are arranged. In this way, the cylinder interior 54 is sealed toward the ambient 1.

As shown in FIGS. 4 and 5, the cylinder 46 of the support and guide arrangement 30 has at its bottom side a first spring support 59. A second spring support 72 is provided at a carrier element 71 and a spring 121 is arranged between the spring supports so as to form an energy store. In the exemplary embodiment, this is a tension spring 121.

The piston 45 has two piston seal elements 61, 62. The seal elements 61, 62 separate a displacement chamber 65 from a compensation chamber 66 at least in a partial stroke of the inward travel of the piston 45.

Figure 3:
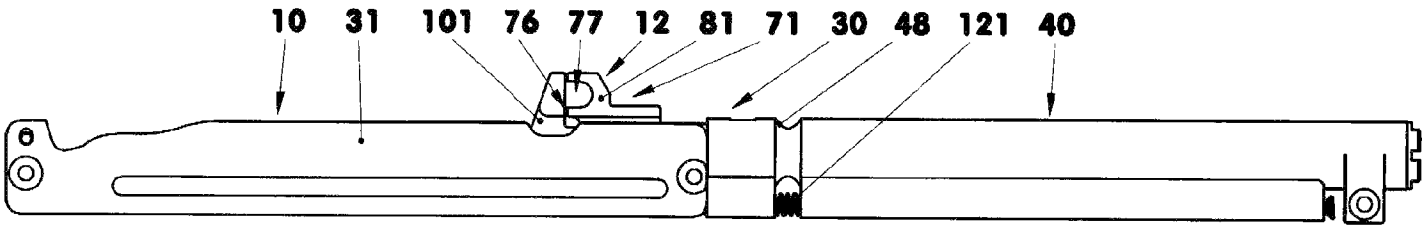
FIG. 3 shows the acceleration and deceleration arrangement in an end position.

Both piston seal elements 61 and 62 are oriented in the exemplary embodiment toward the cylinder bottom 43. The piston seal 61 which is oriented toward the displacement chamber 65 abuts with its outer seal lip 63 the internal cylinder wall 51, at least in the embodiment as shown in FIG. 1. In the end position 12 as shown in FIG. 3 the seal lip 63 (FIG. 5) is released from the internal cylinder wall 51. When subjected to pressure, the shaft seal ring 61 abuts the second piston seal element 62 which may be for example a braking sleeve installed on the piston 45.

The piston rod 44 is the operating element of the deceleration arrangement 40. It includes a piston rod head 67 which is engaged with the carrier element in a piston rod receiving structure 97. The piston rod 44 may be rigid or flexible.

The carrier element 71, which, as shown in FIGS. 1-4, consists of two parts, comprises a guide part 81 and a safety part 101 which parts are pivotable relative to one another.

Figure 6:
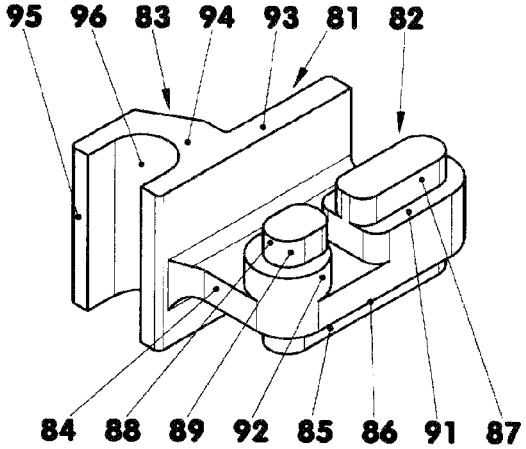
FIG. 6 shows a guide part.

The guide part 81 as shown in FIG. 6 comprises a guide area 82 and an abutment area 83. In the shown exemplary embodiment, the guide part 81 is non-symmetrical with regard to its vertical longitudinal center plane. The guide part 81 however may also be symmetrical with regard to this plane. The guide area 82 comprises in the exemplary embodiment a support web 84 which, at its right side as seen from the deceleration arrangement 40 is provided with a guide pin 85 having an oval cross-section. The support web 84 comprises at this side a transverse guide surface 86, see FIG. 10. After installation of the carrier element 71, the longitudinal direction of the oval guide pin 85 is oriented in the direction of the horizontal section 38 of the guide groove 37. The center point distance in the longitudinal direction is for example four times the height of the guide pin 85. At the left—as seen from the deceleration arrangement—the support web 84 is provided with a guide pin 87 and an accommodation recesses- and guide pin 88. The height thereof corresponds in the exemplary embodiment to the height of the guide pin 85. The guide pin 87 which faces the deceleration arrangement 40 and which has an oval cross-section has half the length of the oppositely disposed guide pin 85. The length of the receiver and guide pin 88 is half the length of the guide pin 87. Both, the guide pin 87 as well as the receiver- and guide pin 88 have a transverse guide surface area 91 adjacent the respective guide section 87, 89. The cylindrical receiver section 92 of the receiver- and guide pin 88 has a diameter which is greater by 80% than the height of the guide pins 85, 87, 89. When installed, the guide pins 85, 87, 89 are engaged in the guide grooves 37 of the housing 31.

To the support web 84, a longitudinal support member 93 is attached or is integrally formed therewith whose width is for example 40% greater than the width of the guide part 81 and extends beyond the guide pins 85, 87. The longitudinal support member 93 is provided with a carrier stop 94. The height of the carrier stop 94 is in the exemplary embodiment 40% of the height of the guide part 81. For example, the wedge-shaped carrier stop 94 has a step surface 95 which is oriented away from the deceleration arrangement 40. This stop surface 95 has a transverse groove 96 which has a constant cross-section over its width as shown in FIGS. 1-4 and 6. The transverse groove 96 forms a form-locking element. During operation of the combined acceleration and deceleration arrangement 10, the transverse groove 96 extends partially around the carrier 5 after coming into contact with it, which carrier in FIGS. 1 and 2 has the form of a cylindrical pin.

The guide part 81 further comprises a piston rod receiver 97, which is oriented toward the deceleration arrangement 40. In the rod receiver, the piston rod head 67 is firmly or releasably accommodated, see FIG. 4.

Figure 7:
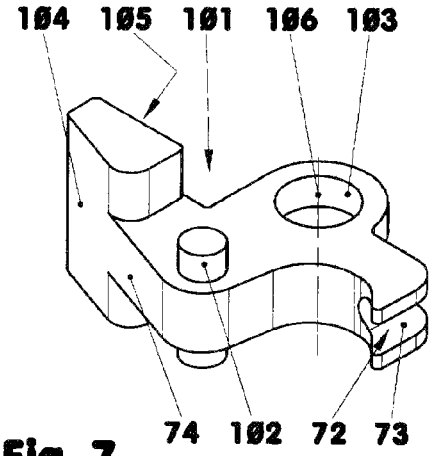
FIG. 7 shows a safety security part.

FIG. 7 shows a safety part 101. This part has two oppositely arranged guide pins 102, the spring receiver 72 a bearing ring 103 and a carrier stop 104. The width of the safety part 101 and its width over the guide pins 102 correspond in the exemplary embodiment to the respective dimensions of the guide part 81.

The spring receiver 72 of the carrier element 71 has a double hook 73 which extends around the head 122 of the tension spring 121 when installed. The hook 73 which is bent toward the front side 74 prevents an unhooking of the spring 121 in the park position 11 as well as during the whole stroke of the carrier element 71 in the direction toward the end position 12.

The inner diameter of the bearing ring 103 of the safety part 101 is greater, by a few tenths of a millimeter than the diameter of the receiving section 92 of the guide part 81. When assembled, see FIGS. 2 and 4, the safety part 101 is pivotally supported on the guide part 81 by means of the bearing ring 103.

The safety part 101 may also be connected to the guide part 81 by way of a film joint. Furthermore, the safety part 101 and the guide part 81 may be supported by a common bearing bolt 75.

The carrier stop 104 which is wedge-shaped in the exemplary embodiment has an engagement surface 105 which faces in the direction of the deceleration arrangement 40. In FIG. 7, the engagement surface is planar. The plane of the engagement surface extends in the exemplary embodiment normal to the plane extending through the guide pin 102 and the center line 106 of the bearing ring 103. The line of intersection between the two planes is disposed between the guide pin 102 and the center line 106 of the bearing ring 103.

The engagement surface 105 of the safety part 101—like the stop surface 95 of the guide part 81—may be provided with a transverse groove. These transverse grooves may have for example identical dimensions.

The two stop and engagement surfaces 95, 105 of a carrier element 71 are shown in the representation of FIGS. 2-4 facing in opposite directions. Their normal vectors therefore point in opposite directions at least after leaving the park position 11.

The separation gap 76 between the guide part 81 and the safety part 101 is shown in FIG. 4 displaced toward the safety part 101 with respect to the pivot joint 75. At least, as shown in FIG. 4, the upper end 78 of the separation gap 76 adjacent the carrier cavity 77 of the carrier element 71 may be disposed after leaving the park position 11 in a plane which his normal to the plane extending through the guide pin 102 and the center line 106 of the pivot joint 75. The line of intersection of these planes then again coincides with the center line 106 of the pivot joint 75 or is displaced therefrom in the direction of the safety part 101. In a bow-like or polygon-shaped configuration of the end 78 of the separation gap 76 each point is disposed either on the plane extending through the centerline 106 of the pivot joint 73 or displaced therefrom in the direction of the safety part 101.

In the installed state of the acceleration and deceleration arrangement 10, it is for example arranged on a drawer. Then the furniture body is provided with a fixed carrier 5 for example a cylindrical pin. With the drawer open, the acceleration and deceleration arrangement 10 is for example in the park position 11, see FIG. 1. The guide part 81 is held completely in the horizontal section 38 of the guide tracks. The safety part 101 which is pivoted toward the guide part 81 is disposed with its guide bolt 102 in the guide section 39 which is inclined toward the horizontal section 38. The carrier element 71 is secured in the park position 11 by means of the force of the energy store 121 acting on the safety element 101 and also by the guide pin 102 abutting the guide track section 39 in a force and/or form-locking manner. Upon closing of the drawer, the carrier 5 contacts the engagement surface 95 of the guide part 81. The carrier is centered in the transverse groove 96. Upon further closing of the drawer the carrier 5 moves the guide part 81 toward the end position 12. The carrier element 71 is released from the park position. The safety part 101 pivots into the horizontal section 38 of the guide track 37. The engagement surface 105 of the safety part 101 is pivoted in the process toward the carrier 5, which, in this way, is held between the two stop surfaces 95, 105 essentially without play. Because of the form-locking engagement between the carrier 5 and the acceleration and deceleration arrangement 10, the position of the drawer or the door normal to the stroke direction 55 is fixed during movement. The drawer or door can therefore be accurately guided even by a guide system with large tolerances.

In the acceleration and deceleration arrangement 10, the carrier element 71 acts on the piston rod and the piston 45 of the cylinder-piston unit 41. Immediately with the beginning of the inward movement of the piston rod 44, the seal ring 63 is pressed onto the internal cylinder wall 65 while being deformed. The displacement chamber 65 is quasihermetically separated from the compensation chamber 66. Upon further inward movement of the piston rod 44 toward the cylinder bottom 43, the volume of the displacement chamber 65 becomes smaller. The gas pressure that is for example air pressure in the displacement chamber 65 increases and acts as internal force on the piston seal element 61 and the braking sleeve 62. In addition, the piston rod seal 58 seals in the exemplary embodiment the compensation chamber 66 against the ambient at least during a partial stroke of the piston rod whereby a vacuum is generated in the compensation chamber. In this way, the speed of the drawer or the door is much reduced.

With increasing stroke of the piston rod 44, the seal ring 63 of the piston seal element 61 reaches the beginning of the longitudinal groove 52. As soon as the sealing ring has passed the beginning of the longitudinal groove 52 as shown in FIG. 5, air is discharged from the displacement chamber 65 via the groove 52 which forms a throttling channel into the compensation chamber 66. The pressure in the displacement chamber 65 drops for example suddenly. The seal element 62 at this point may still be in contact with the internal cylinder wall 51.

The energy store 121 of the acceleration and deceleration arrangement 101, which is discharged after the release from the parking position 11, pulls the carrier element 71 further toward the right as shown in FIG. 4.

The piston rod 44 of the acceleration and deceleration arrangement 10 is further moved inwardly. As soon as the piston seal element 61 is completely released from the internal cylinder wall 51, additional air flows from the displacement chamber 65 into the compensation chamber 66. The piston seal element 61 assumes again its start-out position that it had before the beginning of the stroke movement. The drawer or door which is now almost completely closed has now only a small residual speed.

During opening of the drawer, the carrier element 71 of the acceleration and deceleration arrangement 10 is moved from the end position 12 as shown in FIG. 3 toward the park position 11. During this movement, the energy store 121 is charged in that the tension spring 121 is tensioned. The piston 45 of the cylinder piston unit 41 is moved back. As soon as the guide pins 102 of the safety part 101 reach the second sections 39 of the guide track 37, the safety part 101 is pivoted by means of the energy 121, supported possibly by the carrier 5, about the pivot joint 75 formed by the bearing ring 103 and the receiving section 92. The guide part 81 remains in the horizontal section 38 of the guide track 37. The carrier element 71 is now in the park position 11. The carrier 5 is released. The drawer or door can now be further opened with almost no resistance.

The acceleration and deceleration arrangement 10 can be used for closing and/or opening a drawer or a door.

The acceleration and deceleration arrangement 10 can be so designed that the displacement chamber 65 of the cylinder-piston unit 41 is arranged at the side of the piston rod. The park position 11 of the carrier element 71 then faces the deceleration arrangement 40.

Figure 8:
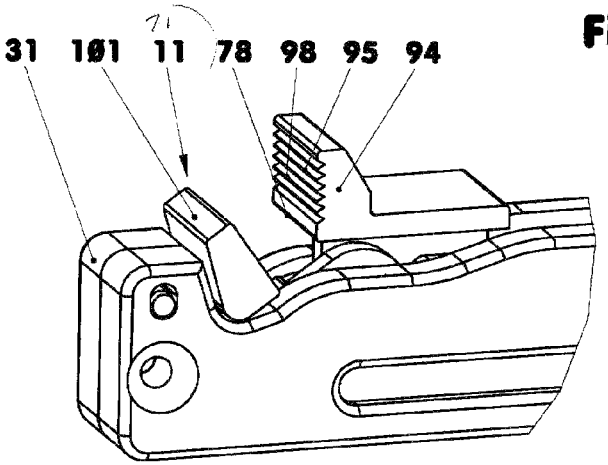
FIG. 8 shows a detail of the safety security part with a tooth-like engagement element of a carrier element.

FIG. 8 shows another embodiment of the acceleration and deceleration arrangement 10 with a two-part carrier element 71. This arrangement is to a large extent designed like the acceleration and deceleration arrangement 10 shown in FIGS. 1 to 7. The stop surface 95 of the guide part 81 is provided with a tooth structure 98. This form-locking element which is oriented in a transverse direction facilitates an automatic centering with a carrier 5 which is provided with a counter-tooth structure.

The safety part 101 is for example identical with the safety part 101 as shown in FIG. 7. Its contact or stop surface 105 may also be provided with a form-locking element, for example a tooth structure. Also, in this exemplary embodiment, the pivot joint 73 is arranged with respect to the safety part 101 between the engagement surface 105 and the spring support 72.

Figure 9:
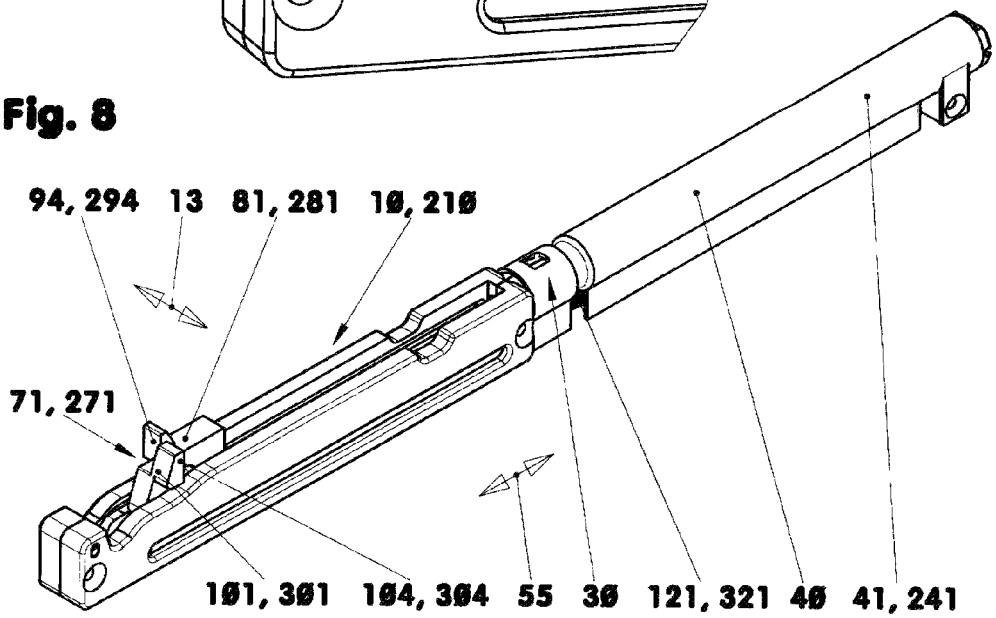
FIG. 9 shows the engagement element of a carrier element with offset engagement surfaces.

FIG. 9 shows a combined acceleration and deceleration arrangement 10 whose carrier element 71 has two carrier stops 94, 104 which are displaced relative to each other in a transverse direction 13. The stops 95, 105 are planar in this embodiment. However, they may also be provided with convex or concave, engagement structures or tooth structures etc. The design of the acceleration and deceleration arrangement 10 otherwise corresponds to that of FIGS. 1-8.

Figure 10:
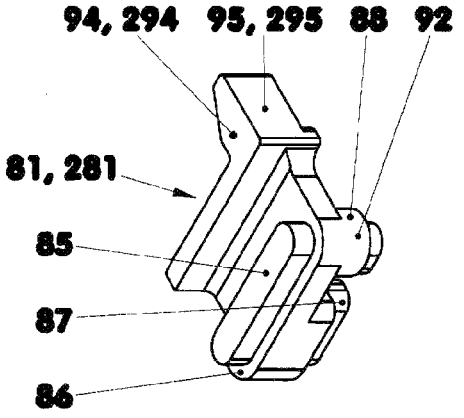
FIG. 10 shows a guide element of FIG. 9.
Figure 11:
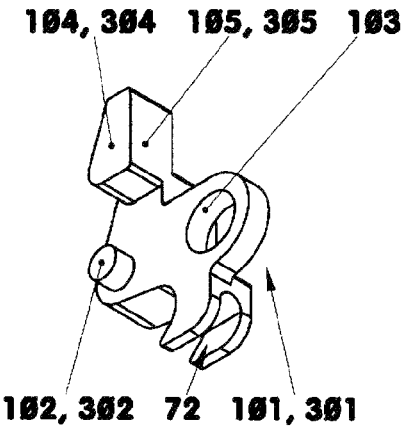
FIG. 11 shows the safety security element of FIG. 9.

FIG. 10 shows the guide part 81 and FIG. 11 shows a safety part 101 of the embodiment of FIG. 9. Also in this exemplary embodiment, the pivot joint 75 is formed by the receiving section 92 and the pivotally supported bearing ring 103. The guide pins 85, 87, 88, 102 and the spring support 72 are arranged in the same way as in the exemplary embodiments of FIGS. 6 and 7.

Figure 13:
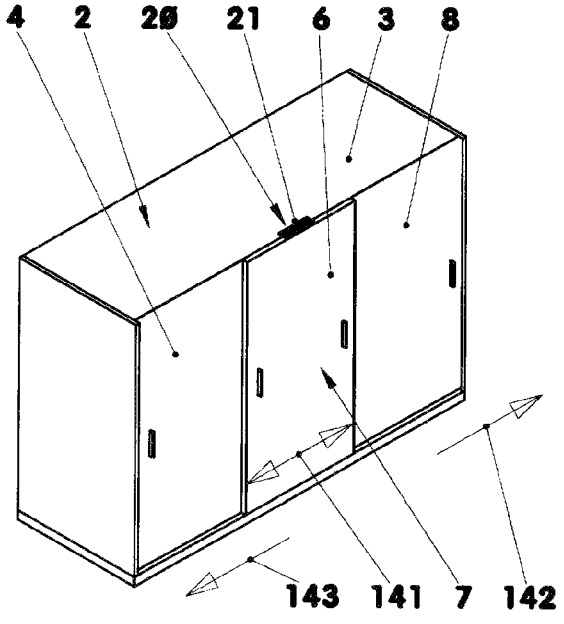
FIG. 13 shows a closet with a slide door system.
Figures 14, 20:
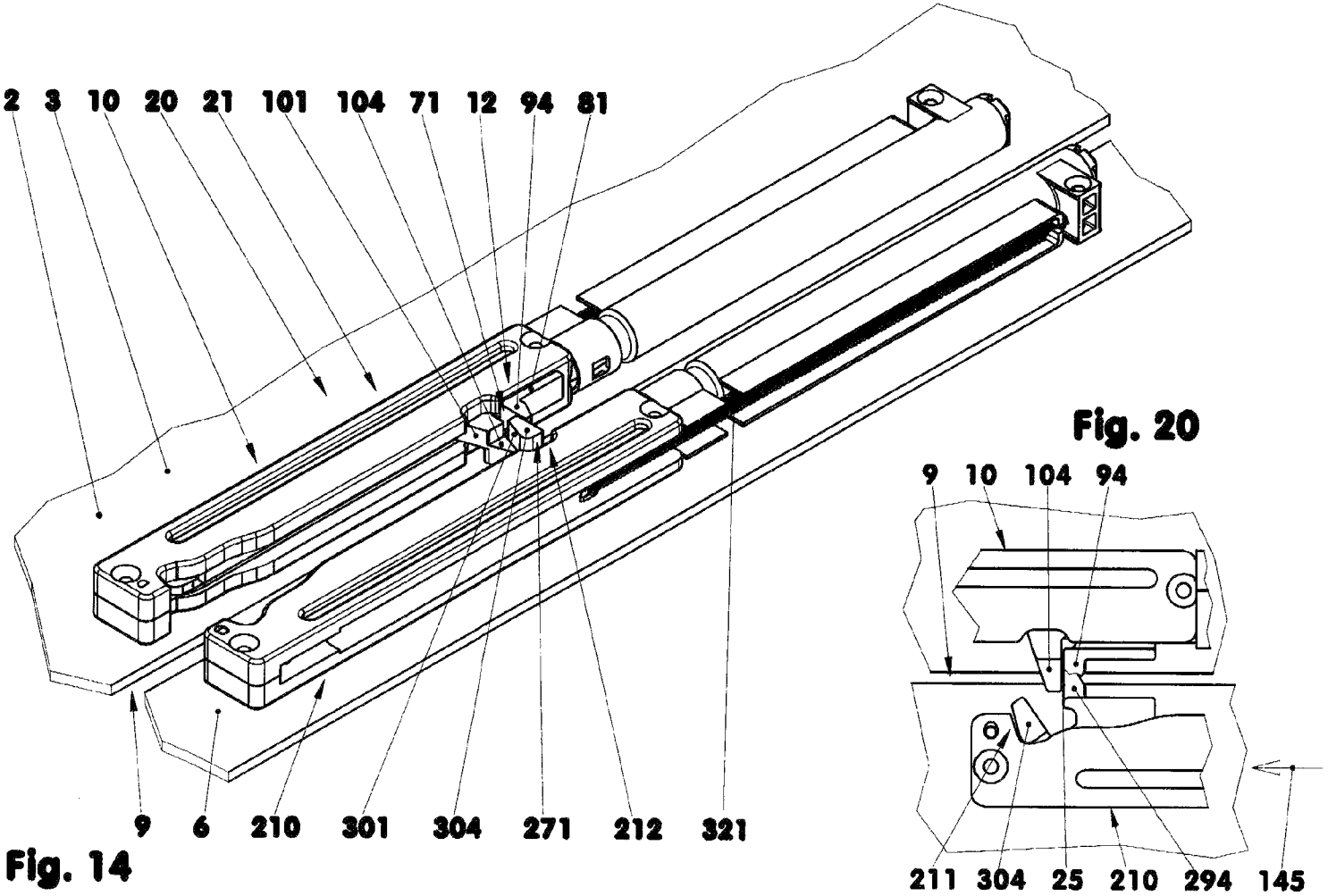
FIG. 14 shows a closing system with two acceleration and deceleration arrangements.
FIG. 20 shows a coupling of the arrangements during closing from the right and FIG. 21 shows a coupling of the arrangements during closing from the left.

FIG. 13 shows the use of a closing arrangement 20 for the center door 6 of a sliding door system 7 of a furniture piece 2 such as a closet. In FIG. 14, the closing arrangement 20 is shown enlarged. It comprises two acceleration and deceleration arrangements 10, 210 of the type as shown in FIG. 9.

The sliding door system 7 shown has three sliding doors 4, 6, 8. The door 4 shown at the left can be opened out of the end position toward the right and closed out of the open position toward the left. The sliding door 8 shown at the right is opened toward the left and closed toward the right. For a defined movement into the open or closed end position in each case an arrangement as shown in FIGS. 1-9 may be used.

The center door 6 of the closet 2 is shown in FIG. 13 guided in front of the two outer doors 4, 8. The center door 6 is wider than the distance between the two outer doors 4, 8 so that the center door 6 overlaps the two outer doors 4, 8. However, the center door 6 may also be guided behind the two outer doors 4, 8. When all doors are in their closed positions, the front of the closet 2 is closed. The doors 4, 6, 8 may be provided with locks if desired.

From the position as shown in FIG. 13, the center door 6 can be opened in two opening directions 141, that is, it can be opened toward the right 142 as well as toward the left 143. In order to close the center door 6, it is moved first manually out of the respective open position in the opposite direction, for example, it is first moved manually and then by means of the center door closing arrangement 20 to the closed position.

The center door closing arrangement 20 is arranged for example at the top of the furniture piece. But it may also be arranged in the furniture piece 2 so that it is not visible from without. It may also be arranged in the lower area of the closet 2.

FIG. 14 shows the center door closing arrangement 20 in a perspective view. It comprises a pull and a braking arrangement pair 21 which comprises two pull and braking arrangements 10, 210. One of these pull and braking arrangements 10 is mounted to the center door 6 for example by screws. Below, the reference numerals above 210 refer to the second arrangement 210. But it is also possible to arrange a pull and braking arrangement 10 on an outer door 4, 8 instead of on the furniture body 3. In connection with a closet 2 with more than three doors 4, 6, 8, a center door closing arrangement 20 may be provided on each of the non-outer doors.

In the exemplary embodiment, both closing and braking arrangements 10, 210 are combined acceleration and deceleration arrangements 10, 210. The two as shown in FIG. 14 identical acceleration and deceleration arrangements 10, 210 are arranged symmetrically with respect to a plane of symmetry which includes the movement gap 9 between the furniture body 3 and the center door 6.

Figures 15, 16, 17:
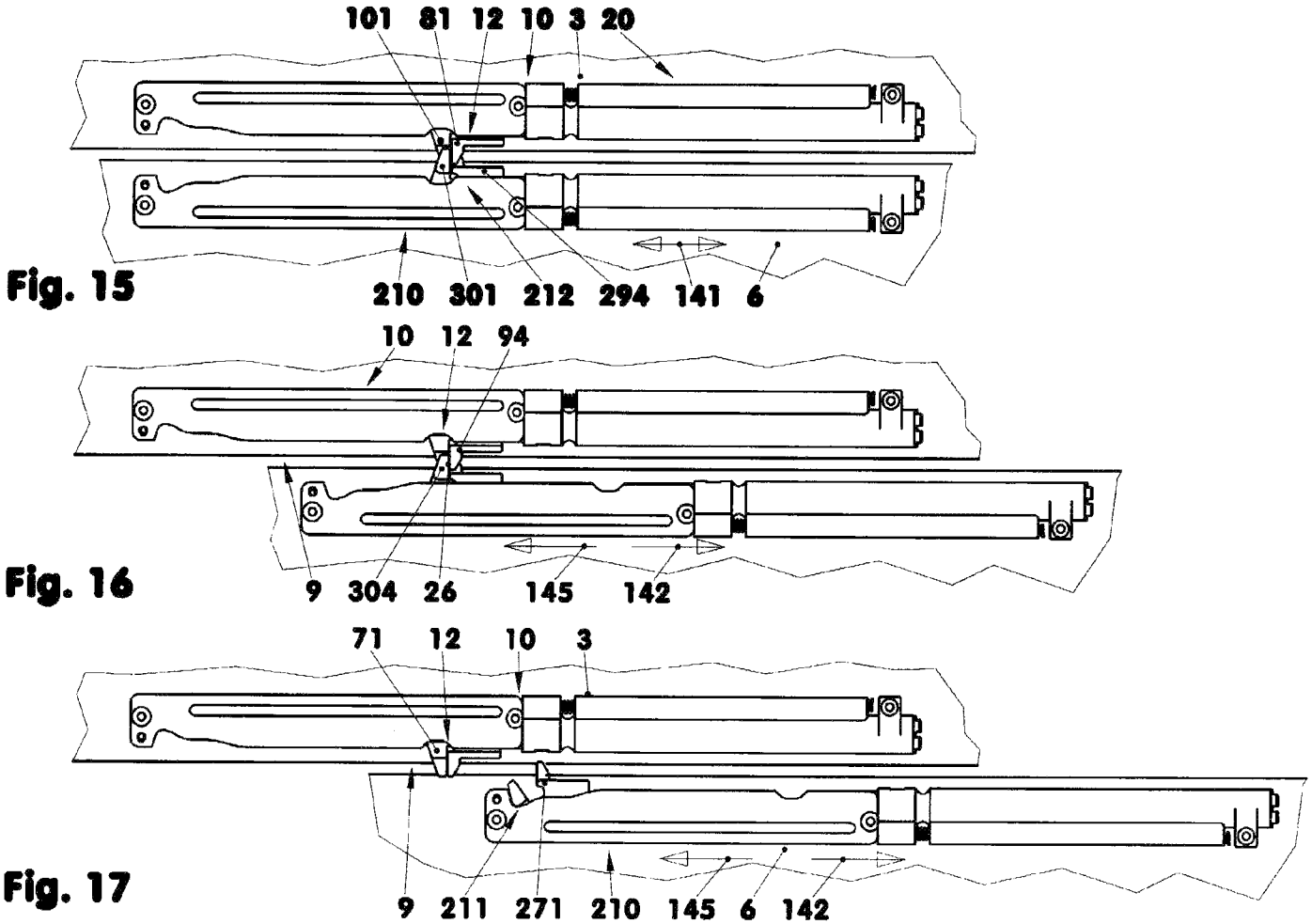
FIG. 15 shows a center door closing arrangement with the middle door in the closed position.
FIG. 16 shows a center door closing arrangement after the beginning of its opening to the right.
FIG. 17 shows a center door closing arrangement with the middle door opened to the right.

When mounted—see FIGS. 14 and 15—the guide-side carrier stop 94, 294 of each carrier element 71, 271 faces the end position 12, 212. This carrier stop 94, 294, which is arranged at the guide part 81, 281 will be designated below as push part 94, 294. The engagement surface 95, 295 of the push part 94, 294 is the push surface 95, 295.

The carrier stop surface 104, 304, of the safety part 101, 301, which in each case faces the park position 11, 211, is called below pull part 104, 304. Its engagement surface 105, 305 is called pull area 105, 305.

FIGS. 15-17 show the opening of the center door 6 to the right. Herein, in each case, at the top, the stationary furniture body 3 and, below, the movable center door is shown. The first pull and braking arrangement 10 is arranged on the furniture body 3 and the second pull and braking arrangement 210 is arranged at the sliding door 6.

The FIG. 15 as well as the FIGS. 13 and 14 show the center door 6 in the basic closed position. The two pull and braking arrangements 10, 120 are arranged side-by-side. The carrier elements 71, 271 are disposed in the arrangement of FIG. 15 in such a way that the pull part 104 of the first arrangement 10 is covered by the pull part 304 of the second arrangement 210. The push part 94 of the first arrangement 10 covers in this representation the push part 294 of the second arrangement 210. The two carrier elements 71, 271 are disposed in their end positions 12, 212, see FIG. 14. The two cylinder piston units 41, 241 are retracted; the energy stores 121, 321 are discharged. The two carrier elements 71, 271 are so arranged that the one carrier element 71, 271 has with regard to the other carrier element 271, 71 the function of the carrier described earlier.

Upon opening the center door 6 to the right, see FIG. 16, the first pull and braking arrangement 10 remains in its initial position. The carrier element 71 remains in its end position 12.

The second pull- and brake arrangement 210 is moved together with the sliding door 6. In the process, the pull part 304 of the second arrangement 210 contacts with its pull surface 305 the push surface 95 of the first arrangement 10. The second carrier element 27 is pulled out of its end position 212 toward the park position 211. In the process, the piston 245 of the cylinder-piston unit 241 is moved out by the piston rod 244. At the same time, the tension spring 321 is tensioned, the energy store 321 is charged.

Also during further opening of the center door 6 in opening direction 142, the carrier element 71 of the first arrangement 10 remains in the end position 12, see FIG. 16. The guide pins 302 of the safety part 301 of the second carrier element 271 move into the inclined section 239 of the guide track 237. By means of the tension spring 321 which is now tensioned the second carrier element 271 is now secured in the park position in a force and form-locked manner. The energy store 321 is charged, the cylinder piston unit is extended, see FIG. 17.

The pull surface 305 of the second carrier element 271 has left the push surface 95 of the guide element 81 of the first carrier element 71 upon pivoting of the safety part 30 into the park position 211. The surfaces 305, 95 are now separated. The pull part 304 of the second arrangement 210 can now pass by the push part 94 of the first arrangement 10. The center door 6 can now be moved further in the opening direction 142 essentially without resistance.

The closing of the center door 6 out of the right side open position occurs in the reversed order. FIG. 17 shows the start-out position in which the center door 6 is open. In this position, the carrier element 71 of the stationary acceleration and deceleration arrangement 10 is in the end position 12. The carrier element 271 of the second acceleration and deceleration arrangement 210 which is movable together with the center door 6 is in the park position 11.

With for example an initial manual closing of the center door 6 in the closing direction 145, the stop surface 295 of the second arrangement 210 abuts the engagement surface 105 of the first arrangement 10, see FIG. 20. The two stop surfaces 294, 104 are then in contact engagement 25. The carrier element 271 of the second arrangement 210 is released from the parking position 211. In the process, it is pivoted into the horizontal position wherein the guide pins 302 run in the horizontal section 238 of the guide track 237. This is shown in FIG. 16. After the pivoting of the safety part 301, the contact engagement 25, 26 have in the opening direction 141 only little play which is for example less than one millimeter.

The energy store 321 of the second acceleration and deceleration arrangement 210, which is discharging after the release from the park position 211 pulls the second carrier element 271 further to the right. The contact engagement 25 between the pull surface 105 of the first arrangement 10 and the stop surface 295 of the second arrangement 210 is relieved as shown in FIG. 20. The second carrier element 271 which is driven by the further discharging spring 321 to move further to the right hits, with its pull surface 305 of the safety element 301, the stop surface 95 of the first carrier element 71. The two engagement surfaces 305, 95 form a contact engagement 26, see FIG. 16. The two acceleration and deceleration arrangements 10, 210 may be in contact with each other at the same time by the contact engagement 25 and the contact engagement 26. The piston rod 244 of the second arrangement 210 is moved further inwardly. The center door 6 is decelerated and moved to its closed end position.

If the center door is moved strongly in the closing direction, with the release of the second carrier element 271 out of the park position 211 also the first carrier element 71 may be pulled out of the end position 12. With this overload safety arrangement, the energy store 121 of the first arrangement 10 is partially charged whereby the center door 6 is additionally decelerated. The center door 6 then has only a small speed or has even stopped. The further movement of the door is as described above.

As soon as the second carrier element 271 has reached its end position 212, the center door 6 may still oscillate in the stroke direction of the two carrier elements 71, 271 because of its mass inertia. The two contact engagements 25, 26 may come apart for example in the process. But in the end the closed door 6 assumes its initial position.

Figure 18:
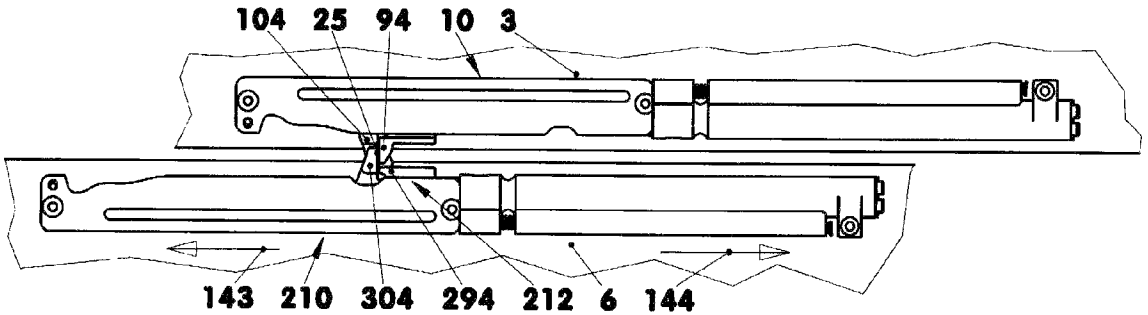
FIG. 18 shows the center door closing arrangement after the beginning of its opening to the left.
Figure 19:
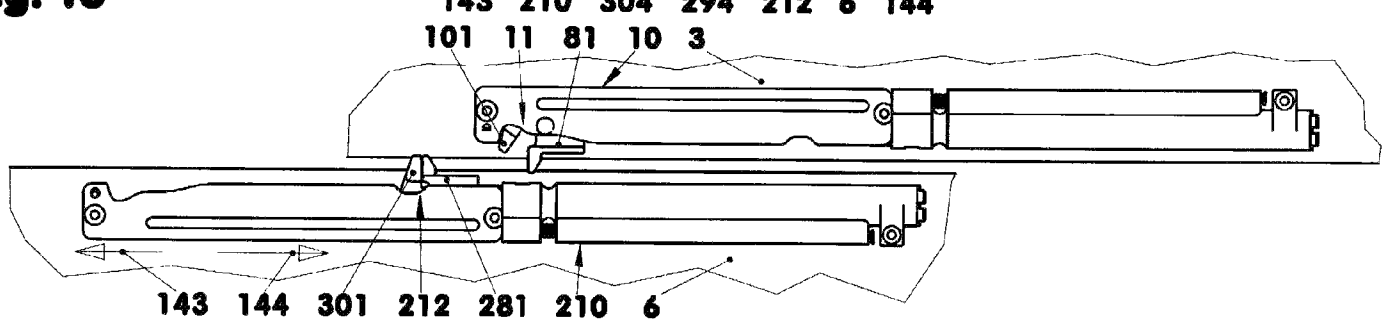
FIG. 19 shows the center door closing arrangement with the middle door opened to the left.

The FIGS. 15, 18 and 19 show the opening of the center door 6 toward the left, see FIG. 13.

Upon opening the center door 6 to the left the carrier stop 104 of the first arrangement mounted to the furniture body 3 comes into contact with the stop member 294 of the second arrangement 210, see FIG. 18. The first carrier element 71 is pulled thereby out of its end position 12. The tension spring 121 of the first arrangement 10 is tensioned thereby. The piston 45 of the first cylinder piston unit 41 is extended. The second carrier element 271 remains in the end position 212. The second energy store 321 is relaxed. The second cylinder piston unit 241 is contracted.

As soon as the first carrier element 71 reaches its park position 11, see FIG. 19, the center door 6 can be first moved in the opening direction 143 essentially without any resistance. The engagement surface 105 of the first arrangement 10 which was pivoted along with the safety part 101 of the first carrier element 71 into park position has been released from the engagement surface 295 of the second arrangement 210.

The closing of the center door 6 from the left that is in the closing direction 144 is shown in FIGS. 19, 18 and 15. In the start-out position as shown in FIG. 19, the carrier element 71 of the first arrangement 10 is in the park position 11 and the carrier element 271 of the second arrangement 210 is in the end position 212.

Figure 21:
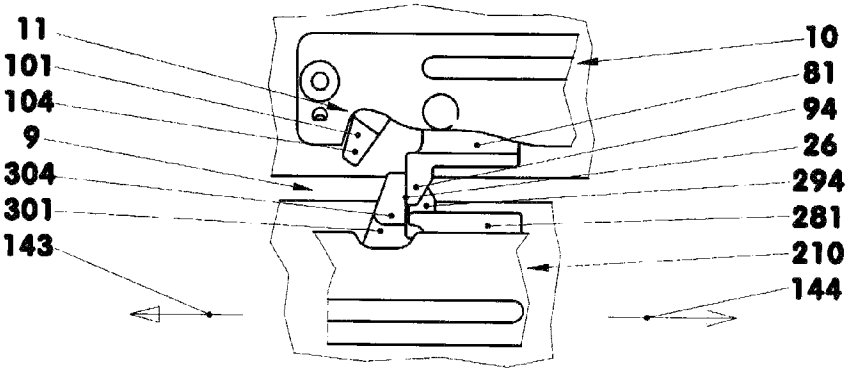

Upon closing of the center door 6, the contact part 304 of the second arrangement 210 abuts the carrier stop 94 of the first arrangement 10, see FIG. 21. The two stop parts 94, 304 form a contact engagement 26. The carrier element 71 of the first arrangement 10 is released from the park position 11, see FIG. 18. The safety part 101 pivots into a horizontal position. The piston rod 44 of the first cylinder piston unit 41 is moved into the cylinder. In the process, the pressure build up in the displacement chamber 65 results in a strong retardation of the center door 6. If necessary, as overload safety feature the second carrier element 271 may be pulled out of the end position 212. The center door 6 has now only a small residual speed. The second carrier element 271 moves again to its end position 212.

With the release of the carrier element 71 from the park position 11, the tension spring 121 of the first arrangement 10 relaxes. It pulls the carrier element 71 toward the end position 12. The contact engagement 26 is relaxed or released. The carrier element 71 of the first arrangement 20 is further moved inwardly until its engagement surface 105 comes into contact with the stop surface 295 of the second carrier element 271. The carrier stop part 104 of the first safety part 101 abuts the stop surface 294 of the second guide part 281 forming a contact engagement 25. The center door 6 is pulled further in closing direction 144.

By means of the first tension spring, the carrier element 71 is moved to the end position 12. The piston 45 is moved inwardly. The mass inertia of the center door 6 can now release the contact engagement 25 of the engagement surface 105 of the first carrier element 71 and the drawer engagement surface 295 of the second carrier element 271. The center door 6 assumes its start-out position as shown in FIGS. 13, 14 and 15.

The two pull and brake arrangements 10, 210 may also be so arranged that the cylinder piston units 41, 241 point toward the left. The movement course is then as described above.

The pull and braking arrangements 21 may have two different pull and braking devices 10, 210. They may have for example, different strokes and/or different cross-sections. In this way, the speed profile over the stroke during closing from the right may be different from the speed profile over the stroke during closing from the left.

One or both pull and braking arrangements 10, 20 may also be so designed that the displacement chamber is arranged between the piston and the cylinder head of the cylinder-piston unit. In such an arrangement, the piston rod is moved into the piston during the park position and is extended in the end position. The definitions of the pull and push surface are like in the definitions provided earlier.

In this exemplary embodiment, the acceleration and deceleration arrangements 10, 210 have pneumatic deceleration arrangements. But they may also have pneumatic dampers whose displacement chamber is in communication with the ambient 1. Also hydraulic dampers may be used with the last-mentioned dampers; the piston rod may be extendable under the force of a spring and abut the carrier element via a stop surface.

Also combinations of the various exemplary embodiments are possible.

REFERENCE NUMERAL LIST

| | |
|---|---|
| 1 | Ambient |
| 2 | Furniture piece, closet |
| 3 | Furniture body, piece |
| 4 | Sliding door |
| 5 | Carrier |
| 6 | Center door |
| 7 | Sliding door system |
| 8 | Sliding door |
| 9 | Movement gap |
| 10, 210 | Acceleration and deceleration arrangement |
| 11, 211 | Parking position |

-continued

| | |
|---|---|
| 12, 212 | End position |
| 13 | Transverse direction |
| 20 | Closing arrangement |
| 21 | Pull and braking arrangement pair |
| 25 | Contact engagement |
| 26 | Contact engagement |
| 30 | Support arrangement |
| 31 | Housing |
| 32 | Housing part |
| 33 | Accommodation area |
| 34 | Guide area |
| 35 | Projection |
| 37, 237 | Guide tracks |
| 38, 238 | Section of 37, guide slot |
| 39, 239 | curved guide section |
| 40 | Deceleration arrangement |
| 41, 241 | Cylinder-piston unit |
| 42 | Cylinder head part |
| 43 | Cylinder bottom |
| 44, 244 | Piston rod |
| 45, 245 | Piston |
| 46 | Piston sleeve |
| 47 | Cylinder sleeve |
| 48 | Annular recess |
| 49 | Bottom end |
| 51 | Natural cylinder wall |
| 52 | Longitudinal groove |
| 53 | Longitudinal groove |
| 54 | Cylinder interior |
| 55 | Stroke direction of movement |
| 56 | Annular recess |
| 57 | Piston rod penetration |
| 58 | Piston rod seal |
| 59 | First spring support |
| 61 | Piston seal element |
| 62 | Seal element |
| 63 | Seal lip seal collar |
| 65 | Displacement chamber |
| 66 | Compensation chamber |
| 67 | Piston rod head |
| 71, 271 | Carrier element |
| 72 | Second spring support |
| 73 | Double hook |
| 74 | Front side |
| 75 | Leaning bolt, joint |
| 76 | Separation gap |
| 77 | Carrier cavity |
| 78 | End of 76 |
| 81, 201 | Guide part |
| 82 | Guide area |
| 83 | Abutment area |
| 84 | Support web |
| 85 | Guide pin |
| 86 | Guide surface |
| 87 | Guide pin, section |
| 88 | Guide pin, section |
| 89 | Guide pin |
| 91 | Transverse guide surface area |
| 92 | Receiving section |
| 93 | Support member |
| 94, 294 | Carrier stop |
| 95, 295 | Stop engagement surface |
| 96 | Transverse groove |
| 97 | Piston rod receiving structure |
| 98 | Tooth structure |
| 101, 301 | Safety part |
| 102, 302 | Opposite pins |
| 103 | Bearing ring |
| 104, 304 | Carrier stop surface |
| 105, 305 | Engagement surface |
| 106 | Center line |
| 121, 321 | Energy storage device, tension spring |
| 122 | Head of spring |
| 141 | Opening direction |
| 142 | Opening direction toward the right |
| 143 | Opening direction toward the left |
| 144 | closing direction toward the right |
| 145 | Closing direction toward the left |

What is claimed is:

1. A combined acceleration and deceleration arrangement (10, 210) comprising a support and guide arrangement (30) including two guide tracks (37, 237) which are arranged opposite each other, each having two guide track sections (38, 39, 238, 239) extending at an obtuse angle with respect to each other; a carrier element (71, 271) movably supported by the support and guide arrangement (30) between a park position (11, 211) and an end position (12, 212) and having at least two carrier engagement stops (94, 104; 294, 304) adapted in shape for engaging a carrier (5); an energy storage device (121, 321) which is arranged on the support and guide arrangement (30) and the carrier element (71, 271), and which is repeatedly chargeable and dischargeable and is charged when the carrier element (71, 271) is in the park position (11, 211) and discharged when the carrier element (71, 271) is in the end position (12, 212); and an operating element (44, 244) of the combined acceleration and deceleration arrangement connected to the carrier element (71, 271), the carrier element (71, 271) comprising a guide part (81, 281) and a securing part (101, 301) having a carrier stop (104) and being pivotally supported by a support section (92) of the guide part (81, 281) so as to be pivotable about the support section (92) away from, and toward a stop (94) of the guide part (81, 281) for firmly engaging the carrier (5), the guide part (81, 281) and the securing part (101, 301) each forming one of the carrier engagement stops (94, 294, 104, 304) and the securing part (101 including opposite pins (102) spaced from the support section (92) and also accommodated in the opposite guide tracks (37, 237) to retain the engagement stop (104) in abutment with the opposite carrier stop (94), wherein, with the carrier element (71, 271) in the park position (11, 211), the guide part (81, 281) is disposed in the guide tracks (37, 237) which extend parallel to the stroke direction (55) of the operating element (44, 244) and the pins (102) of the securing part (101, 301) are disposed in the obtusely inclined guide track section (39, 239) for tilting the securing part (101, 301) away from the end part (81, 281) and for securing the carrier element (71, 271) in its park position, the energy storage device (121, 321) being connected to the securing part (101, 301), at an area thereof, with respect to the support section (92), opposite the engagement stop (104, 304), and the operating element (44, 244) of the deceleration arrangement (40) being connected to the guide part (81, 281).

2. The combined acceleration and deceleration arrangement (10, 210) according to claim 1, wherein at least one carrier stop (94, 104) includes a form-locking element (96, 98).

3. The combined acceleration and deceleration arrangement (10, 210) according to claim 1, wherein the deceleration arrangement (10, 210) includes a pneumatic cylinder-piston unit (41, 241).

4. The combined acceleration and deceleration arrangement (10, 210) according to claim 1, wherein the engagement stops (94, 104, 294, 304) have engagement surfaces (95, 105, 295, 305) which are displaced relative to each other In a transverse direction (13) relative to the stroke directions (35).

5. A system comprising two pull and brake arrangements (21) formed by two combined acceleration and deceleration arrangements (10, 210) according to claim 4, wherein the engagement surfaces (95, 295) and opposite engagement surfaces (305, 105) of the two carrier elements (71, 271), which are facing each other, form at least in a partial stroke range of the acceleration and deceleration arrangements (10, 210) in each case a contact engagement (25, 26), whereby, upon movement of one of the pull and brake arrangement in one direction, the carrier element of one of the pull and brake arrangements is moved out of its rest position to its park position while the storage device thereof is charged and, upon movement of the other of the pull and brake arrangements in the opposite direction, the carrier element of the other of the pull and brake arrangements is moved to its park position while its storage device is charged, and, in each case, upon return of the respective pull and brake arrangement to the rest position, the respective storage device is discharged.

6. The system according to claim 5, wherein the two acceleration and deceleration arrangements (10, 210) are identical.

* * * * *